US010625528B2

(12) United States Patent
Takahashi

(10) Patent No.: US 10,625,528 B2
(45) Date of Patent: Apr. 21, 2020

(54) FOIL TRANSFER METHOD

(71) Applicant: Roland DG Corporation, Hamamatsu-shi, Shizuoka (JP)

(72) Inventor: Fumihiro Takahashi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 220 days.

(21) Appl. No.: 15/792,797

(22) Filed: Oct. 25, 2017

(65) Prior Publication Data

US 2018/0111402 A1 Apr. 26, 2018

(30) Foreign Application Priority Data

Oct. 26, 2016 (JP) ..... 2016-209924

(51) Int. Cl.

| | |
|---|---|
| ***B41M 5/382*** | (2006.01) |
| ***B44C 1/17*** | (2006.01) |
| ***B41J 11/00*** | (2006.01) |
| ***B41J 13/10*** | (2006.01) |
| ***B41M 5/46*** | (2006.01) |
| *B44B 5/00* | (2006.01) |
| *B44B 5/02* | (2006.01) |

(52) U.S. Cl.

CPC ..... *B41M 5/38242* (2013.01); *B41J 11/007* (2013.01); *B41J 13/103* (2013.01); *B41M 5/46* (2013.01); *B44C 1/1716* (2013.01); *B44C 1/1729* (2013.01); *B44B 5/0095* (2013.01); *B44B 5/028* (2013.01)

(58) Field of Classification Search

CPC ..... B41F 19/00; B41J 11/007; B41J 13/103; B41M 5/382; B41M 5/38242; B41M 5/38214; B41M 5/46; B41M 5/44; B41M 5/48; B41M 5/40; B41M 5/42

See application file for complete search history.

(56) References Cited

U.S. PATENT DOCUMENTS 5,718,523 A * 2/1998 Shiina ..... B41J 2/325 347/177
2011/0244390 A1* 10/2011 Felder ..... B41M 5/44 430/200

FOREIGN PATENT DOCUMENTS

JP 63242563 A * 10/1988 ..... B41J 3/28
JP 2005-313465 A 11/2005
JP 5931555 B2 6/2016

* cited by examiner

*Primary Examiner* — Michael P Wieczorek
(74) *Attorney, Agent, or Firm* — Keating & Bennett, LLP

(57) ABSTRACT

A foil transfer method of performing foil transfer onto a surface of a transfer subject includes preparing a foil transfer tool including a light output portion, preparing the transfer subject and a transfer foil, stacking the transfer foil and a light absorbing film with optical absorptivity on a surface, of the transfer subject, on which the foil transfer is to be performed, to produce a stack body, and while moving either one of the stack body and the foil transfer tool with respect to the other, putting the foil transfer tool into contact with a surface of the stack body at which the light absorbing film is provided and outputting light from the light output portion.

13 Claims, 6 Drawing Sheets

FOIL TRANSFER METHOD

CROSS REFERENCE TO RELATED APPLICATIONS

This application claims the benefit of priority to Japanese Patent Application No. 2016-209924 filed on Oct. 26, 2016. The entire contents of this application are hereby incorporated herein by reference.

BACKGROUND OF THE INVENTION

1. Field of the Invention

The present invention relates to a foil transfer method.

2. Description of the Related Art

Conventionally, processing technologies of foil transfer that utilize a foil sheet (transfer foil) are known to be used for the purpose of, for example, improving the creativity of design. Regarding such a technology, Japanese Laid-Open Patent Publication No. 2005-313465 describes a foil transfer method of a thermal transfer system (hot stamping method). According to this method, a transfer foil is put on a transfer subject, and a heated pen is pressed onto the transfer foil, so that a desired pattern is formed on a surface of the transfer subject.

However, with the technology described in Japanese Laid-Open Patent Publication No. 2005-313465, the amount of heat (amount of heat input) supplied from the heated pen to the transfer foil may become nonhomogeneous due to, for example, increase or decrease in the scanning speed of the heated pen, which may result in non-uniform transfer. The present inventor actively performed studies and conceived of a foil transfer device that does not easily cause non-uniform transfer. This foil transfer device includes, as a heat supply for the transfer foil, a source of a light having a high response speed at the time of change of the light intensity, for example, a source of laser light.

With such a foil transfer device, the energy of the light output from the light source needs to be absorbed by the transfer foil and converted into thermal energy. However, according to the studies made by the present inventor, the transfer is not performed successfully in the case where a multi-color foil including surface regions of different colors, for example, a hologram foil or the like, is used. This will be described more specifically. With the above-described multi-color transfer foil, the optical absorptivity is different in accordance with the color of the surface region of the transfer foil. Therefore, for example, a region of the multi-color foil that has a high optical absorptivity may be supplied with an excessive amount of heat, and thus the color of the transferred pattern may be changed. A region of the multi-color foil that has a low optical absorptivity may not be transferred sufficiently, and thus the pattern may appear rubbed or sparse.

SUMMARY OF THE INVENTION

Preferred embodiments of the present invention provide foil transfer methods for properly transferring even a multi-color foil including regions of different colors in the case where a light source is used as a heat supply for such a transfer foil.

A foil transfer method according to a preferred embodiment of the present invention performs foil transfer onto a surface of a transfer subject and includes preparing a foil transfer tool including a light output portion; preparing the transfer subject and a transfer foil; stacking the transfer foil and a light absorbing film having optical absorptivity on a surface, of the transfer subject, on which the foil transfer is to be performed, to produce a stack body; and while moving either one of the stack body and the foil transfer tool with respect to the other of the stack body and the foil transfer tool, putting the foil transfer tool into contact with a surface of the stack body at which the light absorbing film is provided and outputting light from the light output portion.

With the above-described foil transfer method, the energy of the light output from the light source is converted into thermal energy stably. More specifically, the amount of heat supplied to the transfer foil is made homogenous in the plane of foil transfer, and thus the transfer non-uniformity is decreased. Therefore, even in the case where, for example, a multi-color foil is transferred, the transferred pattern is prevented from being discolored or appearing rubbed. In addition, the above-described foil transfer method does not require a special transfer foil to be prepared, and a transfer foil commonly used for thermal transfer is usable. Therefore, with the above-described foil transfer method, a foil-transferred item having a desired pattern foil-transferred successfully with a good appearance is produced at relatively low cost.

Light absorbing films according to preferred embodiments of the present invention are light absorbing films for foil transfer that include a colored light absorbing layer and a transparent protective layer.

Foil transfer methods according to preferred embodiments of the present invention make the amount of heat supplied to a transfer foil homogeneous in the plane of foil transfer and perform the foil transfer in a preferred manner.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments according to the present invention will be described with reference to the attached drawings optionally. The preferred embodiments of the present invention described below are not intended to specifically limit the present invention. Components and portions that have the same functions will bear the same reference signs, and overlapping descriptions will be omitted or simplified optionally.

Figure 1:
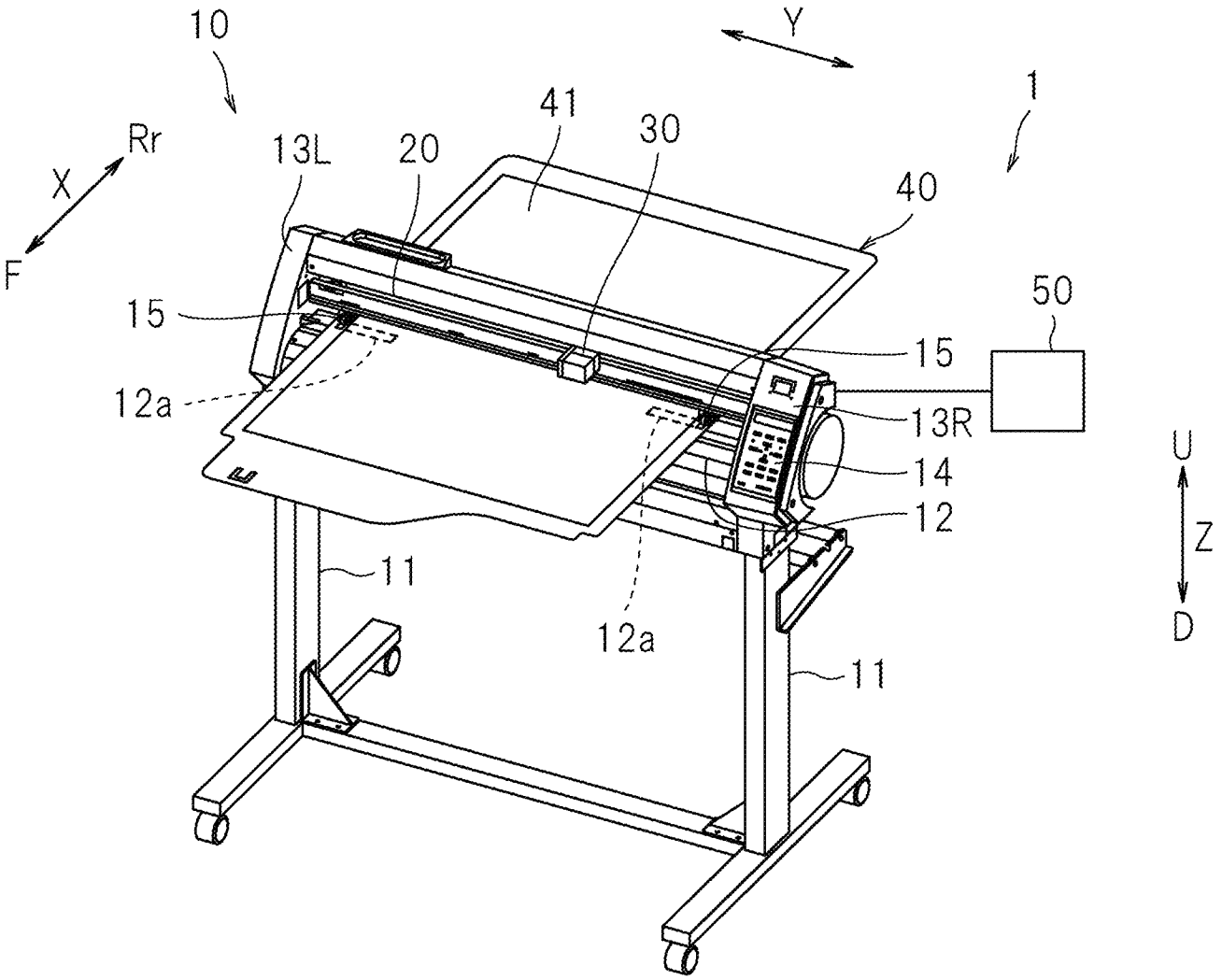
FIG. 1 is a perspective view schematically showing a foil transfer device usable for a foil transfer method according to a preferred embodiment of the present invention.

First, a structure of a foil transfer device 1 will be described. FIG. 1 is a perspective view of the foil transfer device 1 usable for a foil transfer method according to a preferred embodiment of the present invention. In the drawings referred to in the following description, letter Y represents a main scanning direction (also referred to as a "Y-axis direction"). Letter X represents a sub scanning direction (also referred to as an "X-axis direction") perpendicular to the main scanning direction Y. Letter Z represents an up-down direction (also referred to as a "Z-axis direction"). Letters F, Rr, U and D respectively represent "front", "rear", "up" and "down". These directions are provided merely for the sake of convenience, and do not limit the manner of installation of the foil transfer device 1. The direction in which the foil transfer device 1 is installed may be appropriately set in accordance with the form thereof.

The foil transfer device 1 is a device performing foil transfer in the state where a transfer foil 43 (see FIG. 4) is put on a transfer subject 42 (see FIG. 4) to provide a pattern to a surface 42S (see FIG. 4) of the transfer subject 42. The foil transfer device 1 includes a device main body 1, two legs 11 supporting the device main body 10, and a controller 50. The device main body 10 extends in the main scanning direction Y. The device main body 10 includes a base 12, a left wall 13L, a right wall 13R, a guide rail 20, and a carrying table 40. The base 12 is secured to the legs 11. The base 12 extends in the main scanning direction Y. The left wall 13L is provided at a left end of the device main body 10. The right wall 13R is provided at a right end of the device main body 10. The left wall 13L and the right wall 13R are both coupled with the base 12 and the guide rail 20. The left wall 13L and the right wall 13R extend in the sub scanning direction X so as to be perpendicular or substantially perpendicular to the base 12 and the guide rail 20. The right wall 13R is provided with an operation panel 14.

The base 12 is provided with a plurality of cylindrical grid rollers 12*a*. The plurality of grid rollers 12*a* are buried in the base 12 in the state where a top surface of each of the plurality of grid rollers 12*a* is exposed. The grid rollers 12*a* are electrically connected with an X-axis direction feed motor (not shown). The X-axis direction feed motor is controlled by the controller 50. Pinch rollers 15 are provided above each of the grid roller 12*a*. The pinch rollers 15 respectively face the grid rollers 12*a*. The carrying table 40 is held between the grid rollers 12*a* and the pinch rollers 15. On the carrying table 40, a stack body 41 is located. The pinch rollers 15 may be located at any position in the Z-axis direction in accordance with the thickness of the stack body 41. The grid rollers 12*a* and the pinch rollers 15 transport the carrying table 40 in the sub scanning direction X. The grid rollers 12*a* and the pinch rollers 15 are an example of X-axis direction conveyor moving the stack body 41 in the sub scanning direction X.

The guide rail 20 is located in the device main body 10. The guide rail 20 extends in the main scanning direction Y. The guide rail 20 is engaged with a carriage 30. A portion of a wire (not shown) extending in the main scanning direction Y is secured to a rear surface of the carriage 30. The wire is electrically connected with a Y-axis direction scan motor (not shown). The Y-axis direction scan motor is controlled by the controller 50. The wire transports the carriage 30 in the main scanning direction Y along the guide rail 20. A foil transfer tool 31 (see FIG. 2) is located on a front surface of the carriage 30. The carriage 30 is an example of Y-axis direction conveyor moving the foil transfer tool 31 in the main scanning direction Y.

Figure 2:
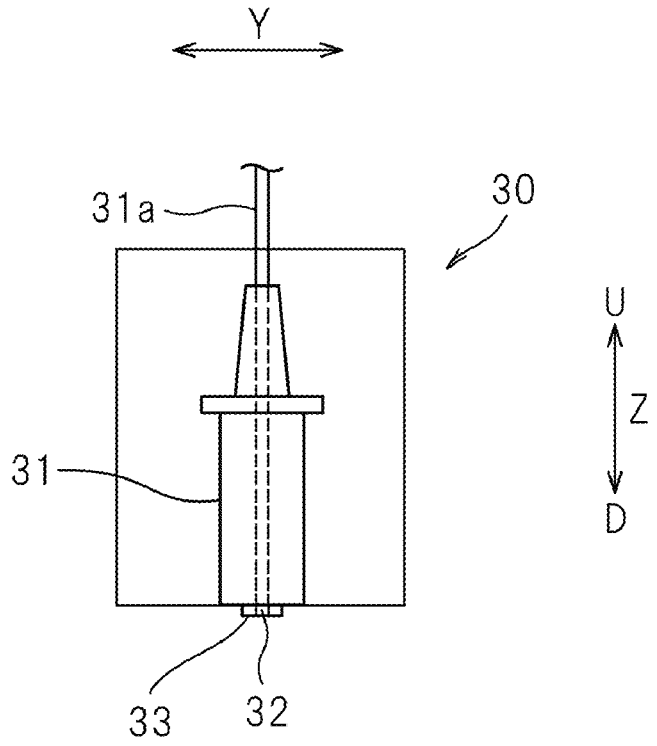
FIG. 2 is a side view schematically showing a structure of a foil transfer tool according to a preferred embodiment of the present invention.

FIG. 2 is a side view schematically showing the foil transfer tool 31 mounted on the carriage 30. The foil transfer tool 31 is located above the carrying table 40. The foil transfer tool 31 preferably has an elongated rod shape. The foil transfer tool 31 includes a laser output portion 32 and a pressing portion 33 both provided on a side facing the carrying table 40 (on the bottom side of the foil transfer tool 31 in FIG. 2).

The laser output portion 32 outputs laser light toward the stack body 41 located on the carrying table 40. The laser output portion 32 is an example of a light output portion. The laser output portion 32 is connected with a laser oscillation device (not shown). The laser oscillation device is controlled by the controller 50. The laser oscillation device is an example of a light output device. The laser oscillation device is, for example, a semiconductor laser. Laser light output from the laser oscillation device is caused to pass the foil transfer tool 31 and is guided to a bottom surface of the foil transfer tool 31 by a fiber optic cable 31*a*. The laser light has a high response speed, and thus allows a light output state (ON) and a light non-output state (OFF) to be switched quickly and also allows the light intensity to be changed quickly. Therefore, even if, for example, the scanning speed of the foil transfer tool 31 is changed, the laser light is output toward the stack body 41 homogeneously. The laser light output from the laser output portion 32 is, for example, blue. The light output device is not limited to a laser output device, and may be, for example, a light emitting diode (LED), a halogen lamp or the like.

The pressing portion 33 is contactable with a surface of the stack body 41. This will be described in more detail. The carriage 30 grasps the foil transfer tool 31 such that the foil transfer tool 31 is slidable in the Z-axis direction. The foil transfer tool 31 includes a solenoid (not shown) and a spring (not shown). The solenoid is controlled by the controller 50. When the controller 50 drives the solenoid, the foil transfer tool 31 protrudes downward. As a result, the foil transfer tool 31 contacts the stack body 41. The spring is located below the solenoid. The spring urges the foil transfer fool 31 upward. When the driving of the solenoid is stopped, the foil transfer tool 31 moves upward by the urging force of the spring. As a result, the foil transfer tool 31 is separated from the stack body 41. The solenoid and the spring are an example of Z-axis direction conveyor moving the foil transfer tool 31 in the Z-axis direction.

The pressing portion 33 may be capable of pressing the surface of the stack body 41 such that the pressure is applied even to the transfer subject 42, which is in a lower layer of the stack body 41. The pressing portion 33 may be capable of pressing the surface of the stack body 41 with a single (one-stage) pressing force or may be capable of pressing the surface of the stack body in a step-by-step manner with a first pressing force and a second pressing force larger than the first pressing force.

The overall operation of the foil transfer device 1 is controlled by the controller 50. The controller 50 is communicably connected with the X-axis direction feed motor, the Y-axis direction scan motor, the laser oscillation device and the solenoid, and is configured or programmed to control these components. The controller 50 is typically a computer. The controller 50 is configured or programmed to drive the X-axis direction feed motor and the Y-axis direction scan motor to move the stack body 41 and the foil transfer tool 31 with respect to each other. The controller 50 is configured or programmed to drive the solenoid to put the foil transfer tool 31 into contact with the surface of the stack body 41. The controller 50 is configured or programmed to drive the laser oscillation device to cause the laser output portion 32 of the foil transfer tool 31 to output light toward the stack body 41.

Figure 3:
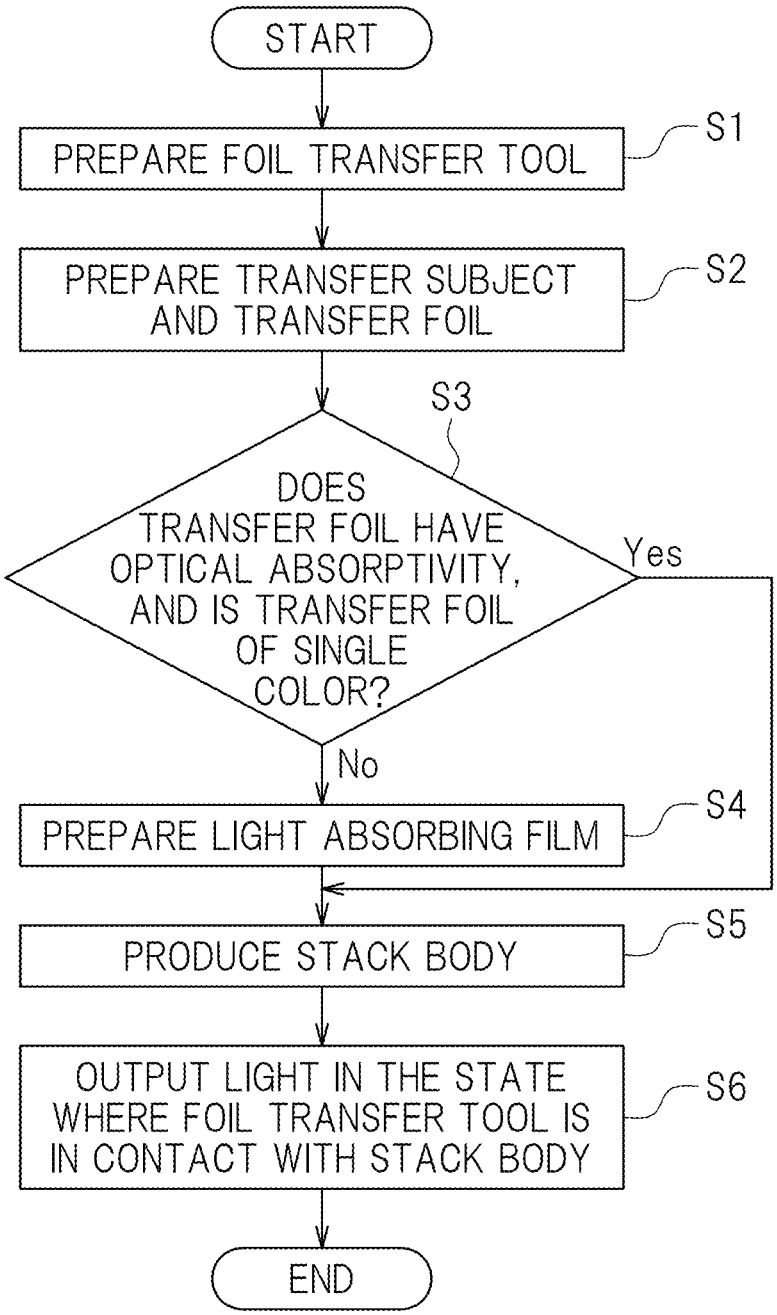
FIG. 3 is a flowchart showing the foil transfer method according to a preferred embodiment of the present invention.
Figure 4:
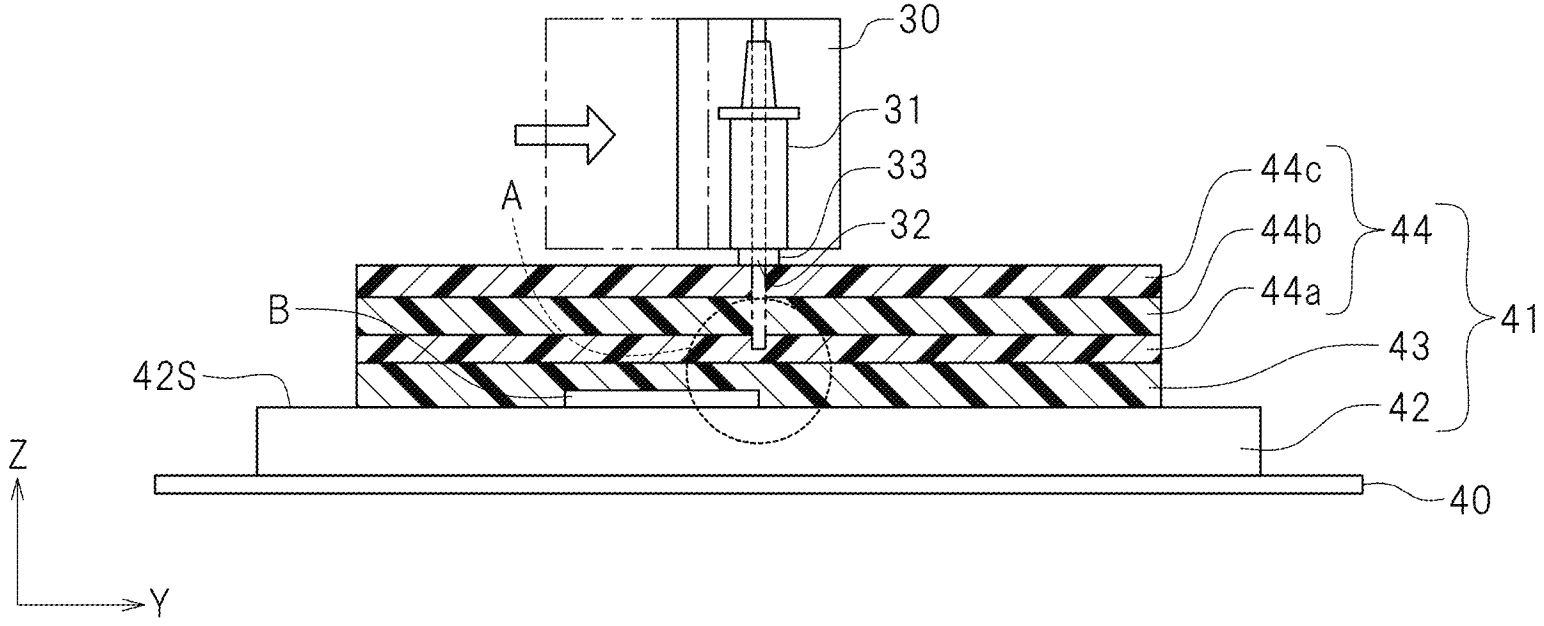
FIG. 4 shows the foil transfer method according to a preferred embodiment of the present invention.

Now, a foil transfer method for performing foil transfer onto the surface 42S of the transfer subject 42 will be described. According to the foil transfer method described in this example, the foil transfer device 1 is used to perform foil transfer onto the surface 42S of the transfer subject 42. FIG. 3 is a flowchart showing the foil transfer method according to a preferred embodiment of the present invention. FIG. 4 shows the foil transfer method according to a preferred embodiment of the present invention. FIG. 4 is a partially cut cross-sectional view.

In step S1, the user prepares the foil transfer tool 31. In this example, the foil transfer device 1 including the foil transfer tool 31 is prepared. A host computer (not shown) and the foil transfer device 1 are connected with each other, and the power of the host computer is turned on. The operation panel 14 is operated to turn on the power of the foil transfer device 1. The host computer has, stored thereon, a foil transfer program, for example.

Next, in step S2, the user prepares the transfer subject 42, onto which the foil transfer is to be performed, and the transfer foil 43 including a pattern to be transferred onto the transfer subject 42. There is no specific limitation on the transfer subject 42. The transfer subject 42 may be, for example, an item of a paper material such as plain paper, drawing paper, Washi (traditional Japanese hand-made paper) or the like; a fabric material; a resin material such as acrylic resin, poly(vinylchloride), polyester, polyethylene-terephthalate, polycarbonate or the like; rubber; leather; or the like; or may be a stack body including a layer formed of a metal material, a glass material, a ceramic material or the like and a pre-processed layer (adhesive layer) provided on the above-mentioned layer.

The transfer foil 43 may be any transfer foil generally commercially available for thermal transfer as, for example, a hot stamp foil or the like. Specific examples of the hot stamp foil include a metallic foil such as a gold foil, a silver foil or the like; a half metallic foil, a pigment foil, a multi-color printing foil; a hologram foil; an anti-electrostatic breakdown foil; and the like.

Figure 5:
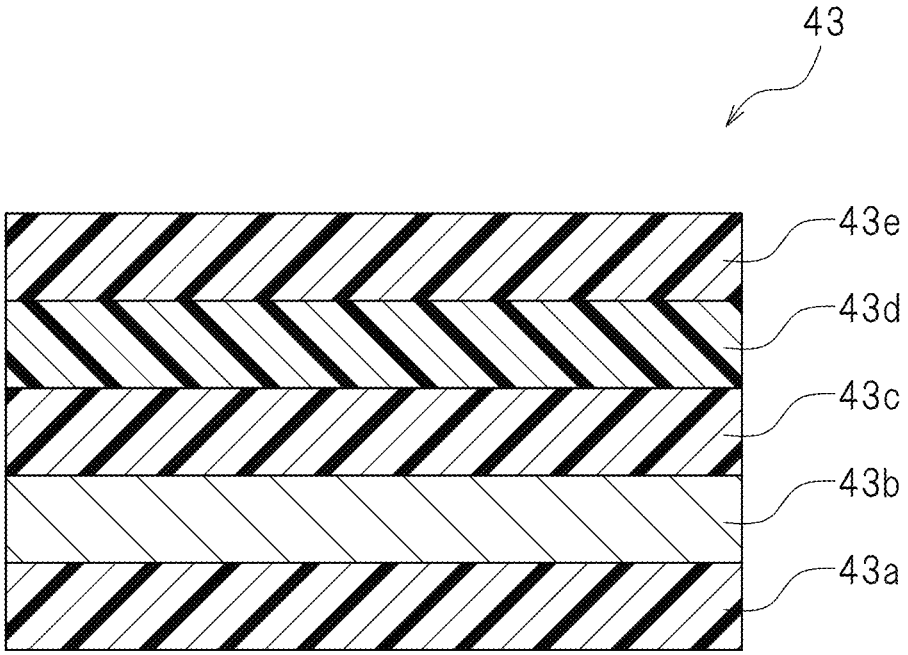
FIG. 5 is a cross-sectional view schematically showing a transfer foil according to a preferred embodiment of the present invention.

FIG. 5 is a cross-sectional view schematically showing the transfer foil 43 according to a preferred embodiment of the present invention. The transfer foil 43 shown in FIG. 5 includes an adhesive layer 43*a*, a vapor-deposited layer 43*b*, a colored layer 43*c*, a release layer 43*d* and a base layer 43*e* stacked in this order.

The adhesive layer 43*a* is structured to be melted when being heated to, for example, about 120° C. to about 180° C. and thus to be adhesive to the transfer subject 42. The adhesive layer 43*a* has a thickness in the stacking direction of, for example, about 1 μm to about 2 μm. The vapor-deposited layer 43*b* provide a metallic tone or luster to the pattern. The vapor-deposited layer 43*b* is formed of, for example, aluminum by vapor deposition. The vapor-deposited layer 43*b* has a thickness in the stacking direction of, for example, about 0.03 μm to about 0.05 μm. The colored layer 43*c* provides a hue to the pattern. The colored layer 43*c* may form an outermost layer of the foil-transferred item after the foil transfer. Therefore, the colored layer 43*c* may be a layer that determines the durability, for example, the abrasion resistance, heat resistance or the like, of the transferred pattern. The colored layer 43*c* has a thickness in the stacking direction of, for example, about 1 μm to about 2 μm.

The release layer 43*d* is peeled off together with the base layer 43*e* after the foil transfer. The release layer 43*d* is structure to have the adhesive force thereof decreased when being heated to about 120° C. to about 180° C., for example, and thus to be peelable from the colored layer 43*c*. The release layer 43*d* is typically more highly light-transmissive, for example, more highly transparent, than the colored layer 43*c*. The release layer 43*d* has a thickness in the stacking direction of, for example, about 0.02 μm. The base layer 43*e* is a layer that prevents the transfer foil 43 from being broken or twisted when being transferred. The base layer 43*e* improves the shape stability or the rigidity of the transfer foil 43 and thus allows the transfer foil 43 to maintain the shape thereof independently. The base layer 43*e* is typically more highly light-transmissive, for example, more highly transparent, than the colored layer 43*c*. The base layer 43*e* is formed of, for example, a plastic film of polyester or the like. The base layer 43*e* has a thickness in the stacking direction of, typically, about 1 μm to about 20 μm, for example, about 12 μm.

The transfer foil 43 shown in FIG. 5 preferably has a five-layer structure, for example. The transfer foil according to a preferred embodiment of the present invention is not limited to this. The transfer foil may include a single layer, two layers, three layers, four layers, or six or more layers. In the case of being, for example, a silver foil or a hologram foil, the transfer foil typically does not include the colored layer and may include four layers, for example, the adhesive layer, the vapor-deposited layer, the release layer and the base layer, or include a smaller number of layers. In the case of a pigment layer with no metallic tone or a multi-color printing foil, the transfer foil typically does not include the vapor-deposited layer and may include four layers, for example, the adhesive layer, the colored layer, the release layer and the base layer, or include a smaller number of layers. In the case where, for example, the base layer also has a function of the release layer, the base layer and the release layer may be integral with each other.

Next, in step S3, the user determines whether or not the transfer foil 43 has optical absorptivity and whether or not the transfer foil 43 is of a single color. Whether or not the transfer foil 43 has optical absorptivity may be determined based on, for example, whether or not the transfer foil 43 include the colored layer 43*c*. In other words, whether or not the transfer foil 43 has optical absorptivity may be determined based on whether or not the transfer foil 43 has a hue. Whether or not the transfer foil 43 is of a single color may be determined based on whether or not the transfer foil 43 has a plurality of hues. The determination may be performed visually by the user comparing the transfer foil 43 against, for example, a color chart or the like, or may be performed by use of a measurement device such as a so-called colorimeter or color difference meter.

In an example, first, a surface of the transfer foil 43 is divided into a plurality of regions having the same area size. Next, the user compares each of the divided regions against a color chart of the Munsell hue circle defined by the Japanese Industrial Standards (JIS) Z 8721:1993 to determine whether or not each divided region has a hue. In the case where each of the regions has a hue, the user represents the hue by the Munsell color system. Next, the user makes an evaluation on whether or not the transfer foil 43 has a first hue and a second hue having a hue angle exceeding 0° with respect to the first hue. In the case where the transfer foil 43 is of the same hue (combination of hues having a hue angle of 0°) in the Munsell hue circle, the user determines that the transfer foil 43 is of a single color. By contrast, in the case where the transfer foil 43 has the first hue and the second hue, the user determines that the transfer foil 43 is not of a single color. In another example, the user determines whether a first region and a second region of the transfer foil 43 are of the same hue, of adjacent hues (combination of hues having a hue angle exceeding 0° and less than, or equal to, 15°), of similar hues (combination of hues having a hue angle exceeding 15° and less than, or equal to, 45°), or complementary hues (combination of hues having a hue angle exceeding 45°) in the Munsell hue circle. In the case where all the regions of the transfer foil 43 are of the same hue, the user determines that the transfer foil 43 is of a single color. Alternatively, in the case where all the regions of the transfer foil 43 are of the same hue or of adjacent hues, the user may determine that the transfer foil 43 is of a single color.

In the case where the transfer foil 43 has optical absorptivity and is of a single color (Yes in step S3), the process advances to step S5. In the case where the transfer foil 43 does not have optical absorptivity or is not of a single color (No in step S3), the process advances to step S4. The above-described determination may be performed in accordance with the type of the transfer foil 43. Specifically, in the case where the transfer foil 43 is a silver foil, a multi-color printing foil, a hologram foil, an anti-electrostatic breakdown foil or a half metallic foil, the transfer foil 43 may be determined as does not having optical absorptivity and/or does not being of a single color. In this case, the process may advance to step S4.

Figure 6:
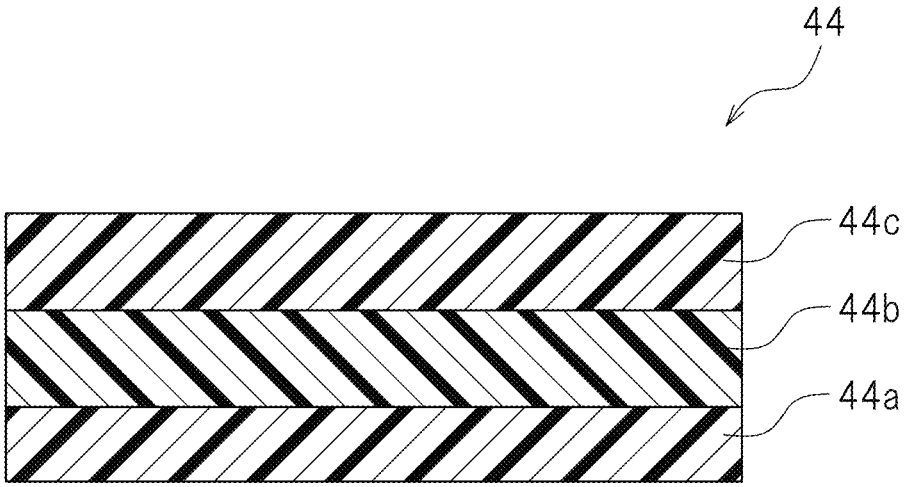
FIG. 6 is a cross-sectional view schematically showing a light absorbing film according to a preferred embodiment of the present invention.

In step S4, the user prepares a light absorbing film 44 having optical absorptivity. FIG. 6 is a cross-sectional view schematically showing the light absorbing film 44 according to a preferred embodiment of the present invention. The light absorbing film 44 shown in FIG. 6 includes a light absorbing layer 44*a*, an adhesive layer 44*b* and a protective layer 44*c* stacked in this order. The light absorbing film 44 preferably is a single color film, for example.

The light absorbing layer 44*a* is able to absorb laser light of a predetermined wavelength output from the laser output portion 32 of the foil transfer tool 31 and convert the energy of the laser light into thermal energy. The light absorbing layer 44*a* is resistant to heat of about 100° C. to about 200° C., for example. The light absorbing layer 44*a* is made of, for example, a resin such as polyimide or the like. The light absorbing layer 44*a* is preferably of a single color, for example. From the point of view of converting the optical energy into the thermal energy efficiently, it is preferred that the light absorbing layer 44*a* has a hue complementary to the hue of the laser light output from the laser output portion 32. It is preferred that the hue of the light absorbing layer 44*a* has a hue angle in the range of, for example, 180°±45° (preferably ±30°, for example, ±15°) with respect to the hue of the laser light output from the laser output portion 32 in the Munsell hue circle defined by the Japanese Industrial Standards (JIS) Z 8721:1993. More specifically, in the case where the laser light output from the laser output portion 32 is blue, it is preferred that the light absorbing layer 44*a* is yellow. The light absorbing layer 44*a* may be thinner than the protective layer 44*c* or thicker than the protective layer 44*c*. The light absorbing layer 44*a* preferably has a thickness in the stacking direction of, for example, about 1 μm to about 10 μm.

The adhesive layer 44*b* is a layer integrating the light absorbing layer 44*a* and the protective layer 44*c*. The protective layer 44*c* is a layer that prevents the light absorbing film 44 from being broken or twisted at the time of foil transfer. The protective layer 44*c* improves the shape stability or the rigidity of the light absorbing film 44 and thus allows the light absorbing film 44 to maintain the shape thereof independently. The protective layer 44*c* is typically more highly light-transmissive, for example, more highly transparent, than the light absorbing layer 44*a*. The protective layer 44*c* has optical absorptivity of a level significantly lower than that of the light absorbing layer 44*a*. There is no specific limitation on the material of the protective layer 44*c*. The protective layer 44*c* is formed of, for example, a plastic film of polyester or the like. The protective layer 44*c* preferably has a thickness in the stacking direction of, for example, about 1 μm to about 20 μm from the point of view of improving the shape stability and the rigidity of the light absorbing film 44 and transmitting the thermal energy to the transfer foil 43 efficiently.

The light absorbing film 44 shown in FIG. 6 preferably has a three-layer structure. The light absorbing film according to a preferred embodiment of the present invention is not limited to this. The light absorbing film may include a single layer, two layers, or four or more layers. The light absorbing film may include, for example, the light absorbing layer and the protective layer. In the case where, for example, the light absorbing layer also has a function of the protective layer, the light absorbing layer and the protective layer may be integral with each other.

Next, in step S5, it is produced the stack body 41. For example, in the case where step S4 is omitted, the user stacks the transfer foil 43 on the surface 42S, of the transfer subject 42, on which the foil transfer is to be performed, and thus produces the stack body 41. In other words, the user produces the stack body 41 with no use of the light absorbing film 44. By contrast, in the case where step S4 is performed, as shown in FIG. 4, the transfer foil 43 and the light absorbing film 44 are stacked in this order on the surface 42S, of the transfer subject 42, on which the foil transfer is to be performed, and thus the stack body 41 is produced. The transfer foil 43 actually has a five-layer structure as shown in FIG. 5, but is shown as a single layer in FIG. 4. Although not shown, the transfer foil 43 is located such that the base layer 43*e* faces the light absorbing film 44 and such that the adhesive layer 43*a* faces the transfer subject 42. The light absorbing film 44 is located such that the light absorbing layer 44*a* faces the transfer foil 43 from the point of view of transmitting the thermal energy to the transfer foil 43 efficiently. In other words, the protective layer 44*c* of the light absorbing film 44 defines the outermost surface of the stack body 41. The user places the stack body 41 on the carrying table 40 of the foil transfer device 1 and secures the stack body 41 to the carrying table 40 such that the stack body 41 is not shifted during the foil transfer.

Next, in step S6, the user operates the host computer connected with the foil transfer device 1 to instruct execution of the foil transfer program. The foil transfer program generates, when data on a pattern to be foil-transferred is input by the user, foil transfer data based on the data on the pattern. The data on the pattern input by the user is represented by, for example, a raster data (bit map data) format. The input data on the pattern is converted into foil transfer data. The foil transfer data is represented by, for example, a vector format. The foil transfer data is output to the controller 50 of the foil transfer device 1.

The controller 50 executes the foil transfer based on the output foil transfer data. Specifically, the controller 50 drives the X-axis direction feed motor and the Y-axis direction scan motor to move the stack body 41 and the foil transfer tool 31 with respect to each other. The controller 50 drives the solenoid to put the pressing portion 33 of the foil transfer tool 31 into contact with the surface of the stack body 41. The controller 50 drives the laser oscillation device to cause the laser output portion 32 of the foil transfer tool 31 to output light toward the stack body 41.

In the form shown in FIG. 4, the pressing portion 33 of the foil transfer tool 31 is in contact with the light absorbing film 44 at the outermost surface of the stack body 41. As a result, the transfer foil 43 is pressed against the stack body 41 via the light absorbing film 44. At this point, for example, the pressing force may be intentionally changed in accordance with the material, the ruggedness or the like of the surface of the transfer subject 42. While the stack body 41 and the foil transfer tool 31 are moved with respect to each other in the state where the pressing portion 33 of the foil transfer tool 31 is in contact with the stack body 41, laser light is output from the laser output portion 32 of the foil transfer tool 31 toward the stack body 41. The output laser light passes the protective layer 44*c* and the adhesive layer 44*b* of the light absorbing film 44 to reach the light absorbing layer 44*a*. The energy of the laser light reaching the light absorbing layer 44*a* is converted into thermal energy. The thermal energy is transmitted to the transfer foil 43 as shown in the circle represented by letter A in FIG. 4. As a result, the adhesive layer 43*a* included in the transfer foil 43 is melted, and thus the adhesive layer 43*a*, the vapor-deposited layer 43*b* and the colored layer 43*c* are fixed to the surface 42S of the transfer subject 42. The release layer 43*d* of the transfer foil 43 is changed in quality. In more detail, the adhesive force of the release layer 43*d* is decreased such that the release layer 43*d* is easily peeled off from the colored layer 43*c*. The release layer 43*d* and the base layer 43*e* of the transfer foil 43 and the light absorbing film 44 are separated from the surface 42S of the transfer subject 42. As a result, the foil-transferred item having a desired pattern foil-transferred onto the surface 42S is provided.

In the case where the laser light is output from a position spatially far from the stack body 41, it is needed to closely attach the transfer subject 42, the transfer foil 43 and the light absorbing film 44 in order to transmit the thermal energy in the stack body 41 efficiently. Therefore, a close-attaching mechanism, for example, a mechanism of an electrostatic adsorption system, an air adsorption system or the like is indispensable in order to closely attach the transfer subject 42, the transfer foil 43 and the light absorbing film 44. By contrast, according to the technology disclosed therein, the foil transfer tool 31 is put into contact with the surface of the stack body 41 at the time of foil transfer. Therefore, such a close-attaching mechanism to closely attach the components of the stack body 41 is not needed, which makes the structure of the foil transfer device 1 compact. This decreases the number of components and production cost of the foil transfer device 1.

Figure 7A:
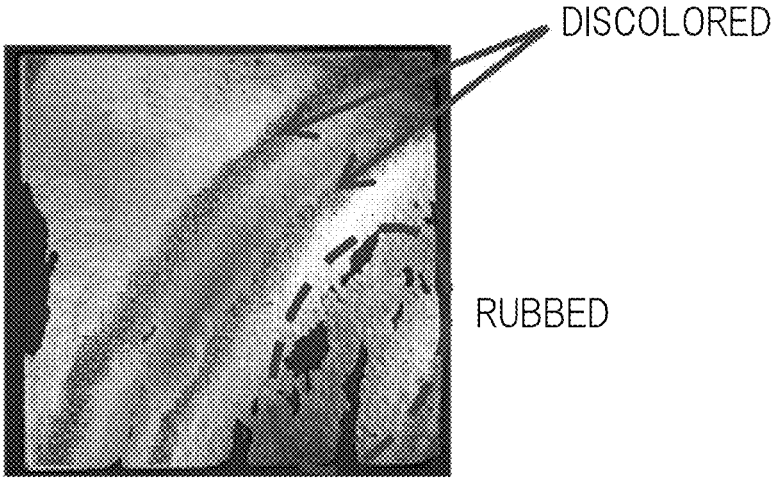
FIGS. 7A and 7B show foil transfer results in an example and a comparative example.
Figure 7B:
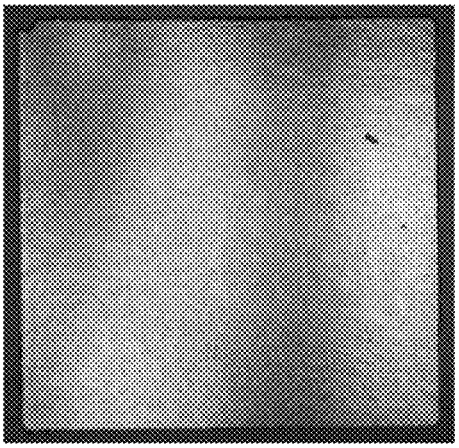

FIGS. 7A and 7B show results of foil transfer performed by use of a hologram foil as the transfer foil 43. FIG. 7A shows the results of transferring a hologram foil to the transfer subject 42 with no use of the light absorbing film 44, namely, the results in a comparative example. As shown in FIG. 7A, in the case where the light absorbing film 44 is not used, the transferred pattern is discolored or appears rubbed. The foil transfer is not performed successfully. A conceivable reason for this is that the hologram foil has different levels of optical absorptivity in different surface regions, and thus the amount of heat supplied to the transfer foil 43 becomes inhomogeneous, which causes transfer non-uniformity.

By contrast, FIG. 7B shows results of transferring a hologram foil to the transfer subject 42 with use of the light absorbing film 44, namely, the results in an example according to the present invention. As shown in FIG. 7B, the use of the light absorbing film 44 allows the hologram foil to be transferred successfully uniformly.

As described above, with the foil transfer method according to a preferred embodiment of the present invention, the optical energy of the laser light output from the laser output portion 32 of the foil transfer tool 31 is converted into the thermal energy stably. Namely, the optical absorptivity is made homogenous at the surface of the stack body 41, so that the amount of heat supplied to the transfer foil 43 is homogenous in the plane of foil transfer. This decreases the transfer non-uniformity, which would otherwise be caused between different regions. Even in the case where the transfer foil 43 is, for example, a multi-color foil having surface regions that are different in the optical absorptivity, the transferred pattern is prevented from being discolored or appearing rubbed. In addition, there is no need to prepare a special transfer foil, and a transfer foil commonly used for thermal transfer is usable. Therefore, a foil-transferred item having a desired pattern foil-transferred successfully with a good appearance is produced at relatively low cost.

In this preferred embodiment, the transfer foil 43 may be a multi-color foil. Specifically, the transfer foil 43 may be a hologram foil. According to the foil transfer method disclosed therein, even in the case where a multi-color foil (e.g., hologram foil) is used, a foil-transferred item having a desired pattern foil-transferred successfully with a good appearance is produced in a preferred manner.

In this preferred embodiment, the color of the laser light output from the laser output portion 32 of the foil transfer tool 31 and the color of the light absorbing film 44 are complementary to each other. This allows the energy of the laser light output from the laser output portion 32 to be converted into the thermal energy efficiently. Therefore, the light intensity of light oscillated by the laser oscillation device may be maintained low, and the energy and the cost for the foil transfer are decreased.

In this preferred embodiment, the light absorbing film 44 includes the light absorbing layer 44*a*, which is colored, and the protective film 44*c*, which is transparent, stacked on each other in the stacking direction. In step S5 of producing the stack body 41, the light absorbing layer 44*a* of the light absorbing film 44 is located to face the transfer foil 43. The provision of the protection film 44*c* prevents the light absorbing film 44 from being broken or twisted at the time of foil transfer. The structure in which the light absorbing layer 44*a* of the light absorbing film 44 faces the transfer foil 43 allows the thermal energy to be transmitted to the transfer foil 43 efficiently.

In this preferred embodiment, the light absorbing layer 44*a* may be thinner than the protective film 44*c* in the stacking direction of the light absorbing film 44. This allows the energy of the laser light to be converted into the thermal energy efficiently, and also prevents sufficiently the light absorbing film 44 from being broken or twisted.

In this preferred embodiment, the foil transfer tool 31 may press the stack body 41 with the first pressing force and the second pressing force larger than the first pressing force. The pressing force of the foil transfer tool 31 may be intentionally changed in accordance with, for example, the material, the ruggedness or the like of the surface of the transfer subject 42, so that the foil transfer is performed more stably. Changing the pressing force changes the surface state of the foil-transferred item to adjust the state of light reflection.

Therefore, a wide variety of creative designs is realized, and the diversity of design or representation of the foil-transferred item is increased.

In this preferred embodiment, before the stack body 41 is produced, it is determined whether the transfer foil 43 has optical absorptivity and whether or not the transfer foil 43 is of a single color. In the case where the transfer foil 43 does not have optical absorptivity or is not of a single color, the transfer foil 43 and the light absorbing film 44 are stacked on the surface, of the transfer subject 42, on which the foil transfer is to be performed, in the production of the stack body in step S5. On the other hand, in the case where the transfer foil 43 has optical absorptivity and is of a single color, the transfer foil 43 is stacked on the surface, of the transfer subject 42, on which the foil transfer is to be performed, in the production of the stack body in step S5. Thus, the stack body does not include the light absorbing film 44.

Preferred embodiments according to the present invention have been described. The above-described preferred embodiments are merely examples, and the present invention may be carried out in any of various preferred embodiments.

In the above-described preferred embodiments, in step S3, the user determines properties of the transfer foil 43 (whether or not the transfer foil 43 has optical absorptivity and whether or not the transfer foil 43 is of a single color). The present invention is not limited to this. For example, the foil transfer device 1 may include an image capturing device such as a camera or the like, and the controller 50 may drive the camera and automatically determine such a property of the transfer foil (e.g., hue) from an image captured by the camera. In the case where, for example, the property of the transfer foil 43 is apparent, step S3 may be omitted. In other words, the process may advance to step S4 immediately after step S2.

In the above-described preferred embodiments, in step S6, the stack body 41 is moved in the X-axis direction while the foil transfer tool 31 is moved in the Y-axis direction and the Z-axis direction. The present invention is not limited to this. The foil transfer device 1 may move only the stack body 41 with respect to the foil transfer tool 31, or may move only the foil transfer tool 31 with respect to the stack body 41.

In the above-described preferred embodiments, the foil transfer device 1 does not include any mechanism that closely attaches the transfer subject 42, and the transfer foil 43, and the light absorbing film 44 of the stack body 41, and does not use the close-attaching mechanism at the time of foil transfer. The present invention is not limited to this. The foil transfer device 1 may include a conventionally known close-attaching mechanism of an electrostatic adsorption system, an air adsorption system or the like, and may use such a close-attaching mechanism at the time of foil transfer.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A foil transfer method for performing foil transfer onto a surface of a transfer subject, the foil transfer method comprising:

preparing a foil transfer tool including a light output portion;

preparing the transfer subject and a transfer foil;

preparing a light absorbing film with optical absorptivity, the light absorbing film being prepared separately from the transfer foil;

stacking the transfer foil and the light absorbing film on a surface, of the transfer subject, on which the foil transfer is to be performed, to produce a stack body;

preparing a foil transfer device provided with the foil transfer tool and a controller configured or programmed to control the foil transfer tool; and while moving either one of the stack body and the foil transfer tool with respect to the other of the stack body and the foil transfer tool, putting the foil transfer tool into contact with a surface of the stack body at which the light absorbing film is provided and outputting light from the light output portion, wherein the foil transfer tool is mounted on a carriage engaged with a guide rail extending in a first direction and configured to move in the first direction by the controller.

2. The foil transfer method according to claim 1, wherein the transfer foil is a multi-color foil.

3. The foil transfer method according to claim 2, wherein the multi-color foil is a hologram foil.

4. The foil transfer method according to claim 1, wherein the light output from the light output portion of the foil transfer tool and the light absorbing film have a complementary color relationship with each other.

5. The foil transfer method according to claim 1, wherein:

the light absorbing film includes a colored light absorbing layer and a transparent protective film stacked on each other in a stacking direction; and a surface of the light absorbing film at which the light absorbing layer is provided is located to face the transfer foil to produce the stack body.

6. The foil transfer method according to claim 5, wherein the light absorbing layer is thinner than the protective film in the stacking direction.

7. The foil transfer method according to claim 1, wherein the foil transfer tool is capable of pressing the stack body with a first pressing force and a second pressing force larger than the first pressing force.

8. The foil transfer method according to claim 1, further comprising determining, before producing the stack body, whether or not the transfer foil has optical absorptivity and whether or not the transfer foil is of a single color; wherein in a case that the transfer foil does not have optical absorptivity or is not of a single color, the transfer foil and the light absorbing film are stacked on the surface of the transfer subject, on which the foil transfer is to be performed.

9. The foil transfer method according to claim 1, wherein producing the stack body comprises placing the light absorbing film on the surface of the transfer foil.

10. The foil transfer method according to claim 1, wherein the foil transfer tool includes a solenoid controlled by the controller, and is configured to move in an up-down direction.

11. The foil transfer method according to claim 1, wherein the transfer foil does not have optical absorptivity.

12. The foil transfer method according to claim 1, wherein the light absorbing film is a single color film.

13. A foil transfer method for performing foil transfer onto a surface of a transfer subject, the foil transfer method comprising:

preparing a foil transfer tool including a light output portion;

preparing the transfer subject and a transfer foil;

preparing a light absorbing film with optical absorptivity, the light absorbing film being prepared separately from the transfer foil;

stacking the transfer foil and the light absorbing film on a surface, of the transfer subject, on which the foil transfer is to be performed, to produce a stack body;

preparing a foil transfer device provided with the foil transfer tool and a controller configured or programmed to control the foil transfer tool; and while moving either one of the stack body and the foil transfer tool with respect to the other of the stack body and the foil transfer tool, putting the foil transfer tool into contact with a surface of the stack body at which the light absorbing film is provided and outputting light from the light output portion, wherein the foil transfer tool includes a solenoid controlled by the controller and is configured to move in an up-down direction.

* * * * *